US006695252B1

(12) United States Patent
Dryer

(10) Patent No.: US 6,695,252 B1
(45) Date of Patent: Feb. 24, 2004

(54) DEPLOYABLE FIN PROJECTILE WITH OUTFLOW DEVICE

(75) Inventor: Richard Dryer, Oro Valley, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/246,082

(22) Filed: Sep. 18, 2002

(51) Int. Cl.[7] ..... F42B 13/32
(52) U.S. Cl. ..... 244/3.28; 244/49
(58) Field of Search ..... 244/91, 49, 87, 244/3.27–3.29

(56) References Cited

U.S. PATENT DOCUMENTS 3,598,345 A * 8/1971 Suter ..... 244/3.27
3,880,383 A * 4/1975 Voss et al. ..... 244/3.27
4,209,147 A * 6/1980 Jones et al. ..... 244/3.28
5,108,051 A * 4/1992 Montet et al. ..... 244/3.28
6,168,111 B1 * 1/2001 Kayser et al. ..... 244/3.29

* cited by examiner

*Primary Examiner*—Galen L. Barefoot
(74) *Attorney, Agent, or Firm*—Renner, Otto, Boisselle & Sklar, LLP

(57) ABSTRACT

A missile or projectile tail section includes an outflow device and a number of deployable fins. The outflow device may be a base bleed device that includes a slow-burning propellant which fills the vacuum created by the projectile's motion through the air. Use of the outflow device may allow the projectile range to be extended by up to 20%. The fins are stowed canted relative to planes that include the axis of the tail section. By canting or tilting the fins relative to the axis of the tail section, increased space is made in the tail section for the outflow device. Although the fins are stowed canted relative to the tail section, they may be configured so as to be deployed such that the axis of the tail section is substantially within the planes of the fins.

34 Claims, 5 Drawing Sheets

DEPLOYABLE FIN PROJECTILE WITH OUTFLOW DEVICE

TECHNICAL FIELD OF THE INVENTION

The general field of the invention is projectiles, specifically projectiles with deployable fins.

DESCRIPTION OF THE RELATED ART

Deployable fins have been utilized in missiles and projectiles fired from launchers, such as launch tubes or gun barrels, in order to reduce size of the launchers, and to increase performance by providing a better fit between the missile and the launcher, thus increasing velocity and range of the projectile. One problem with such deployable fins has been space limitations in the base of the projectile, which limit the size of the fins, and the ability to place other devices or equipment in the base of the projectile. Prior attempts to avoid these shortcomings have included compromises in length and width of the fins, which disadvantageously resulted in reduced performance, such as by reducing projectile stability. Other approaches have been accomplished by folding the fins laterally alongside of the projectile, which severely limits the effectiveness of the fins to stabilize the projectile. Yet another approach has been use of flexible fins that are wrapped around the projectile. The flexibility of these fins limits their ability to stabilize a projectile. Still another approach has been to reduce cargo capacity of the projectile, which is obviously undesirable.

From the foregoing it will be appreciated that improvements are desirable with regard to projectiles having deployable fins.

SUMMARY OF THE INVENTION

According to an aspect of the invention, a projectile tail section includes a outflow device, such as a base bleed device or a rocket, and a plurality of deployable fins stowed within the tail section.

According to another aspect of the device, a projectile includes a tail section with a plurality of deployable fins. The fins are stowed in a canted configuration relative to an axis of the tail section. In addition, the fins may be deployable into a non-canted configuration.

According to yet another aspect of the invention, a projectile tail section includes an outflow device surrounding an axis of the tail section; and a plurality of deployable, substantially planar fins stowed within the tail section around the outflow device. The axis of the tail section is not co-planar with planes of the fins, when the fins are stowed within the tail section.

According to still another aspect of the invention, a projectile tail section includes an outflow device surrounding an axis of the tail section; and a plurality of deployable fins stowed within the tail section around the outflow device. The fins are canted relative to the axis of the tail section, when the fins are stowed within the tail section.

According to a further aspect of the invention, a method of deploying fins for a projectile includes: moving the fins from a stowed configuration to a partially-deployed configuration; and moving the fins from the partially-deployed configuration to a fully-deployed configuration. The fins are within slots in a tail section of the projectile when the fins are in the stowed configuration. The fins are canted relative to an axis of the tail section when the fins are in the partially-deployed configuration. The axis of the tail section is substantially within planes of the fins, when the fins are in the fully-deployed configuration.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

A missile or projectile tail section includes an outflow device and a number of deployable fins. The outflow device may be a base bleed device that includes a slow-burning propellant which fills the vacuum created by the projectile's motion through the air. Use of the base bleed device allows the projectile range to be extended by up to 20%. The fins are stowed canted relative to planes that include the axis of the tail section. That is, when stowed, the planes that the fins are in do not include the axis of the tail section. By canting or tilting the fins relative to the axis of the tail section, increased space is made in the tail section for the outflow device. Although the fins are stowed canted relative to the tail section, they may be configured so as to be deployed such that the axis of the tail section is substantially within the planes of the fins. By canting the fins relative to the axis of the tail section when the fins are stowed, more volume is made available for the presence of the outflow device.

Figure 2:
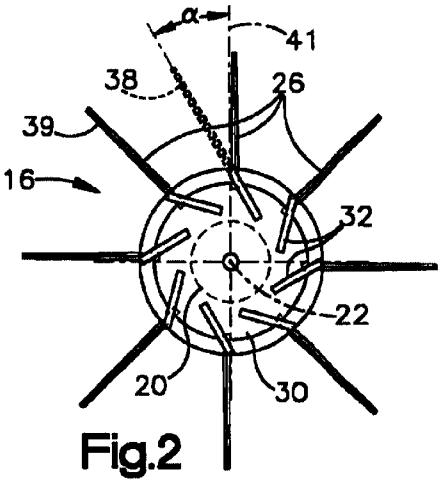
FIG. 2 is a rear view of the projectile of FIG. 1.
Figure 1:
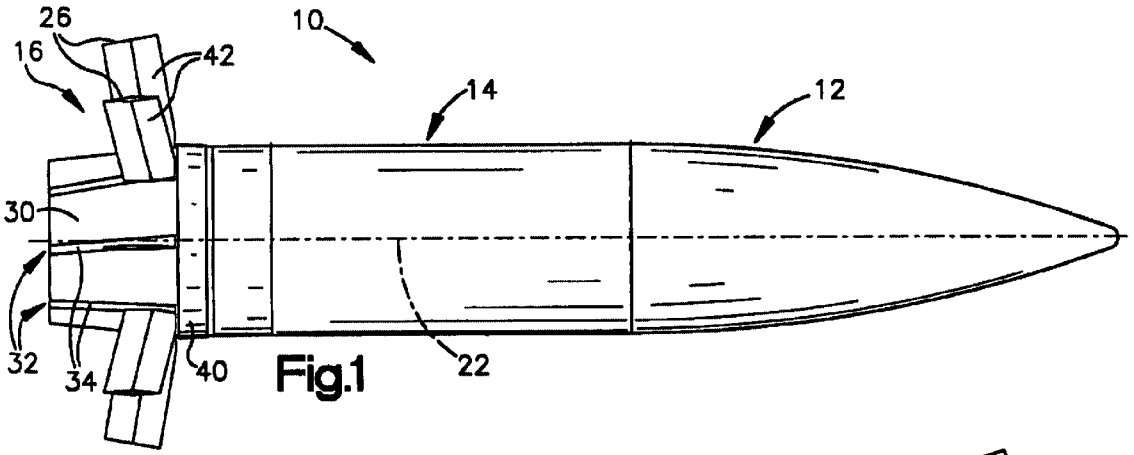
FIG. 1 is a side view of a projectile in accordance with the present invention.

Referring initially to FIGS. 1 and 2, a projectile or missile 10 includes a nose 12, a projectile body 14, and a tail section 16. The tail section 16 includes an outflow device 20, which surrounds an axis 22 of the tail section 16. As is conventional, the axis 22 coincides with the axis of the projectile 10. The tail section also includes a plurality of fins 26. As illustrated, the tail section 16 includes eight fins 26. However, it will be appreciated that the number of fins may be greater or lesser than that shown.

The fins 26 are deployable fins. The fins 26 are initlally stowed within a tail housing 30 of the tail section. The tail housing 30 has a number of slots 32, with each of the slots 32 configured to contain a respective of the fins 26. The fins 26 are initially stowed within the slots 32. In flight, the fins 26 may be deployed, emerging from openings 34 in the slots 32. The deployment of the fins 26 may include partially deploying the fins substantially within the plane of the slots 32, such as in the partially-deployed position 38 indicated in FIG. 2. The fins 26 may then be moved to a fully-deployed position 39 that is within a centerline plane of the projectile 10, that is, a plane which includes the ax is 22.

Various devices and means may be used to extend the fins 26, as described in greater detail below. Although the fins are shown in a centerline plane when fully-deployed, fins 26 alternatively may be configured to be deployed at an angle to the centerline plane. That is, the fins 26 alternatively may be fully-deployed canted at an angle $\alpha$ to planes that include the axis 22 of the tail section 16. The term "canted," as used herein refers generally to being in a plane which is at an angle to the centerline planes (the planes that include the axis 22), such as the centerline plane 41 shown in FIG. 2.

The tail section includes an obturator 40 at a forward part of the tail section 16. The obturator 40 acts as a seal between the projectile 10 and a launcher such as a launch tube or gun barrel. The combustion gases sealed in the launcher by the obturator 40 may be used in extending the fins 26, as is described in greater detail below.

The fins 26 may have wedge-shaped forward portions 42. These wedge portions 42 may be used in the process of deploying the fins 26, to position the fins in their non-canted positions within a centerline plane.

The fins 26 are shown as forward-deploying fins, that is, the fins 26 are anchored to the tail housing 30 at a forward portion of the tail section 16. However, as will be described in greater detail below, the fins 26 may alternatively be aft-deploying fins anchored at the rear portions of the tail housing 30.

Figure 3:
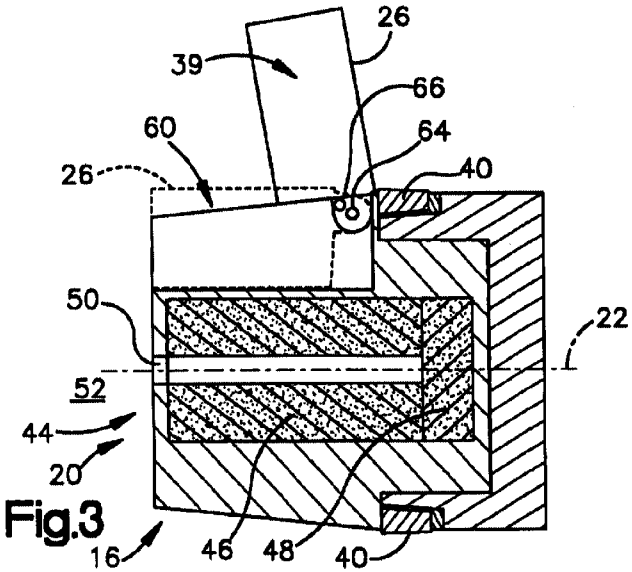
FIG. 3 is a cross-sectional view of the tail section of the projectile of FIG. 1, showing one embodiment outflow device, a base bleed device.

Referring now to FIG. 3, further details may be seen of one embodiment of the outflow device 20, a base bleed device 44. The base bleed device 44 includes a base bleed grain 46 and a base bleed ignitor 48. Before or during flight of the projectile 10, the base bleed ignitor 48 is activated, initiating combustion of the base bleed grain 46. As noted above, the base bleed grain 46 is a slowly-combusting material. Gases produced by the combustion of the base bleed grain 46 pass through a base bleed opening 50 in the tail housing 30. The base bleed gases thus at least partially fill a vacuum region 52 which is formed by forward motion of the projectile 10 (FIG. 1) during flight of the projectile 10. This filling of the vacuum region 52 with gases reduces or eliminates drag which might otherwise result from formation of a full lower partial vacuum at the aft end of the projectile 10. Thus velocity and/or range of the projectile 10 may be increased.

An example of a base bleed grain material is hydroxyl-terminated polybutadiene with ammonium perchlorate added as an oxidizer (HTPB/AP). Examples of suitable ignitor materials include barium potassium nitrate (B $KNO_3$), magnesium potassium nitrate (Mg $KNO_3$), and magnesium Teflon (Mg PTFE).

Figure 4:
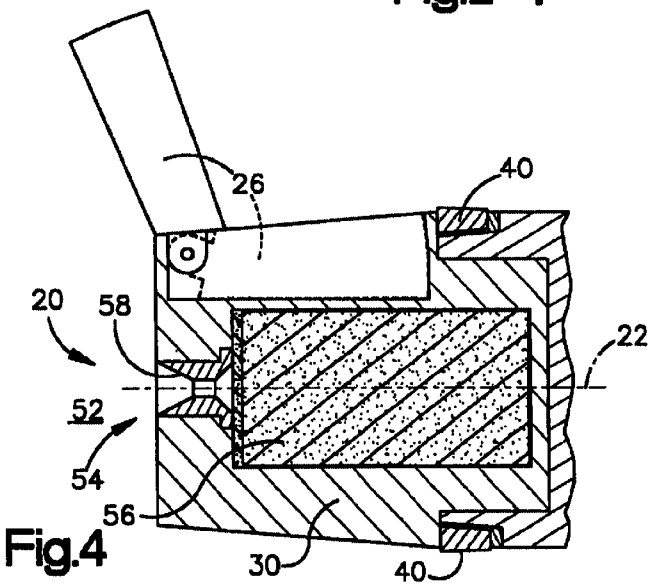
FIG. 4 is a cross-sectional view of the tail section of the projectile of FIG. 1, showing another embodiment outflow device, a rocket motor.

FIG. 4 illustrates another embodiment of the outflow device 20, a rocket motor 54. The rocket motor 54 includes a propellant 56 and a nozzle 58. As the propellant 56 burns, the gasses created by the combustion pass through the nozzle 58 into the region 52 behind the projectile 10. The combustion thereby provides thrust to propel the projectile 10 forward.

In various configurations and embodiments described below, it will be appreciated that the outflow device 20 may be a base bleed device such as the base bleed device 44 shown in FIG. 3, a rocket motor such as the rocket motor 54 shown in FIG. 4, or another suitable device that expels gasses or other suitable materials.

The fin 26 is shown in FIG. 3 in both a stowed position 60 and the fully-deployed position 39. In the stowed position 60, the fin 26 is located within the slot 32. In proceeding from the stowed position 60 to the fully-deployed position 39, the fin 26 rotates about a pin 64. The pin 64 may be a separate piece which fits through a hole in the fin 26 acting as an axle about which the fin 26 rotates. Alternatively, the pin 64 may be part of the fin 26, rotating along with the fin 26.

The tail section 16 includes a lock 66 which maintains the fin 26 in its fully-deployed position 39. The lock 66 may include a spring-and-detent mechanism, as explained in greater detail below.

Figure 5:
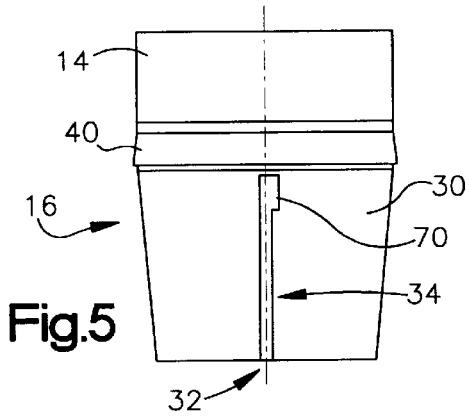
FIG. 5 is a top view of the tail section of the projectile of FIG. 3.
Figure 6:
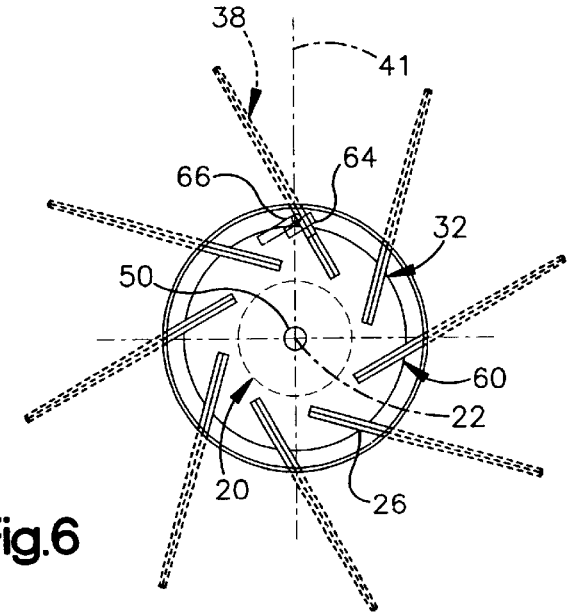
FIGS. 6 and 7 are rear view of the tail section of FIG. 3, illustrating the deployment of the fins.
Figure 7:
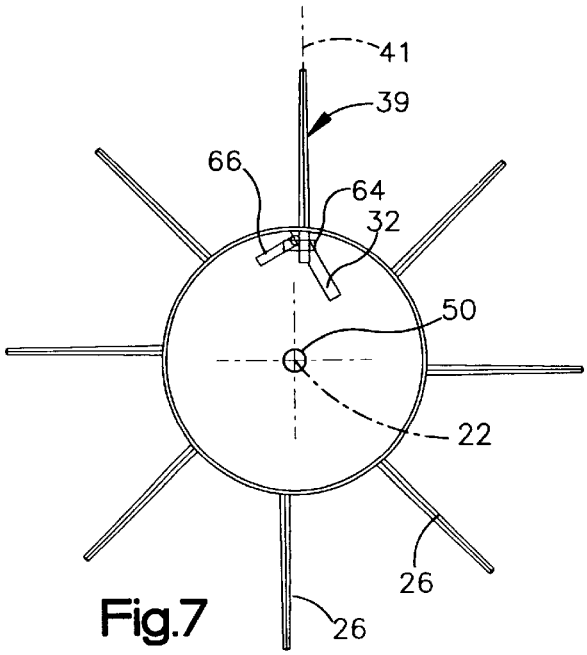

Referring now, in addition to FIGS. 5–7, deployment of the fin 26 from the stowed position 60 to the fully-deployed position 39 is addressed in greater detail. The first step in deployment of the fin 26, shown in FIG. 6, is rotation of the fin 26 about the pin 64, to the partially-deployed position 38. This first step in deployment keeps the fin 26 within the plane of the substantially planar slot 32. The fin 26 is thus maintained canted at an angle a relative to a plane through the axis 22 of the tail section 16. As discussed in greater detail below, this partial deployment of the fin 26 may be accomplished by any of a variety of suitable mechanisms. As one example, a mechanical linkage may be used to actively reposition the fin 26. Alternatively, centrifugal forces from spinning of the projectile 10 may be used to force the fin 26 outward. As another alternative, muzzle blast pressure or aerodynamic forces may be used to effect outward motion of the fin 26.

Spinning of the projectile 10 may be accomplished by any of a variety of suitable, well-known mechanisms or means.

Referring now to FIG. 7, the fin 26 is rotated into a centerline plane, a plane that includes the axis 22 of the tail section 16. As shown in FIG. 5, the opening 34 of the slot has a notch 70 which allows movement of the fin 26 to the fully-deployed position 39. Once the fin 26 is in the fully-deployed position 39, the lock 66 engages, securing the fin 26 in the fully-deployed position 39. In addition, the location of the fin 26 in the notch 70 may aid in maintaining the fin 26 in its fully-deployed position 39, for example by preventing backward folding of the fin 26 into the slot 32.

Movement of the fin from the partially-deployed position 38 to the fully-deployed position 39 may be accomplished by any of a variety of suitable active or passive means. For example, a spring or other suitable mechanical device may be used to force the fin 26 over into the notch 70. Alternatively, a cam surface on the tail housing 30 may engage with the wedge-shaped portion 42 (FIG. 1) of the fin 26, to urge the fin 26 over and into the notch 70. Centrifugal and/or aerodynamic forces may also be utilized to move the fin 26 to the fully-deployed position 39. It will be appreciated that the mechanism to move the fin from the partially-deployed position 38 to the fully-deployed position 39 may be the same as or may be different from the mechanism used to move the fin 26 from the stowed position 60 to the partially-deployed position 38.

Once the fin 26 reaches the fully-deployed position 39, the lock 66 engages, securing the fin 26 in place. Thus the fin 26 may be maintained in the fully-deployed position 39 even against forces, such as aerodynamic forces, that would tend to urge the fin 26 back toward the partially-deployed position 38 and/or the stowed position 60.

It will be appreciated that the lock 66 may itself provide the force which moves the fin 26 to the fully-deployed position 39. As an alternative, the lock 66 may merely provide force aiding another mechanism in moving the fin 26 to the fully-deployed position 39.

Figure 8:
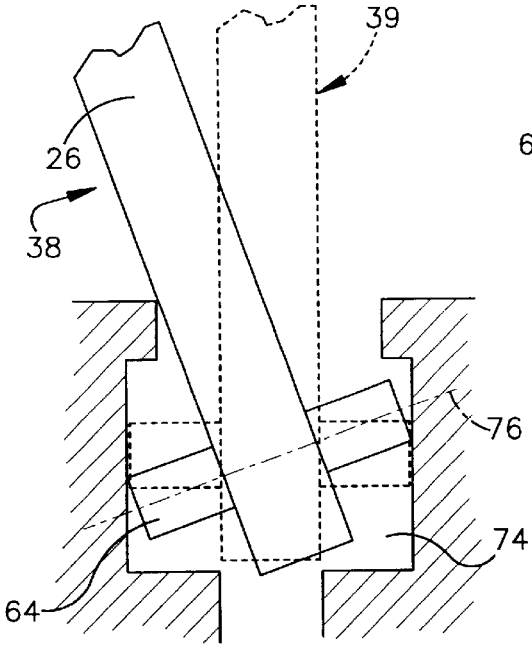
FIG. 8 is a detailed view of one possible fin and pin configuration for the tail section of FIG. 3.

Turning now to FIG. 8, details regarding movement of a pin 64 attached to the fin 26, are shown. As illustrated in FIG. 8, the pin 64 is free to wobble within a wobble cavity 74 in the tail housing 30. Thus, the fin 26, including the pin 64 is free to rotate to move the fin 26 from the partially-deployed position 38 to the fully-deployed position 39, with the pin 64 changing position within the wobble cavity 74. The pin 64 is of sufficient length to prevent it from leaving the wobble cavity 74. Thus the pin 64 prevents the fin 26 from being pulled away from the remainder of the tail section 16 while allowing movement of the fin 26 for deployment.

As described above, the movement of the fin 26 may include both rotation about a pin axis 76 of the pin 64, and rotation and/or displacement of the fin 26 other than as rotation about the pin axis 76.

Figure 9:
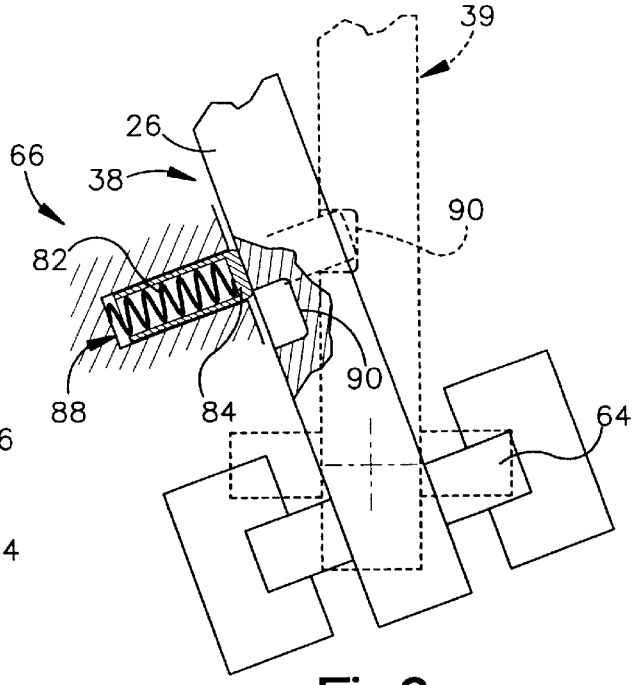
FIG. 9 is a detailed view illustrating another possible fin and pin configuration for the tail section of FIG. 3, as well as a spring-and-detent lock mechanism.
Figure 10:
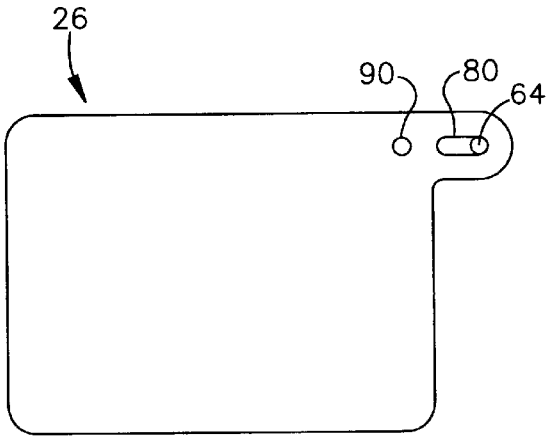
FIG. 10 is a plan view illustrating a fin for use in the tail section of FIG. 3.

Turning now to FIGS. 9 and 10, an alternative configuration is shown for the pin 64 and the lock 66. In this configuration the pin 64 is a separate part from the fin 26. In movement from the stowed position 60 (FIG. 5) to the partially-deployed position 38, the fin 26 rotates about the pin 64 and its pin axis 76. As shown in FIG. 10, the pin 64 passes through an elongated hole 80 in the fin 26. In movement of the fin 26 from the partially-deployed position 38 to the fully-deployed position 39, the fin 26 rotates into a plane which includes the tail axis 22. In this movement the pin 64 travels along the elongation of the elongated hole 80 in the fin 26.

FIGS. 9 and 10 also illustrate a lock 66 consisting of a spring-and-detent mechanism. A spring 82 and a plunger 84 are located within a suitable spring cavity 88 in the tail housing 30. The plunger 84 contacts the surface of the fin 26, with the spring 82 providing a spring force tending to rotate the fin 26 toward the centerline plane (clockwise direction as shown in FIG. 9). The fin 26 includes a detent or depression 90. Rotation of the fin 26 to the fully-deployed position 39 causes the plunger 84 to engage the detent 90. Spring forces from the spring 82 maintain the plunger 84 engaged with the detent 90, thus locking the fin 26 into place in its fully-deployed position 39.

Figure 11:
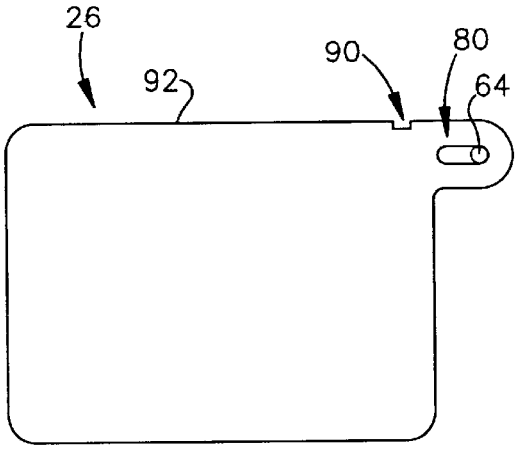
FIG. 11 is a plan view of another embodiment fin for use in the tail section of FIG. 3.

It will be appreciated that many alternative suitable configurations for a spring-and-detent lock are possible. For example, as shown in FIG. 11, the detent 90 may be along an edge 92 of the fin 26, rather than being on the face of the fin 26, as shown in FIG. 10.

Other sorts of spring-assist mechanisms may be utilized to move the fin 26 from the stowed position 60 to the partially-deployed position 38, and/or to move the fin 26 from the partially-deployed position 38 to the fully-deployed position 39.

Figure 12:
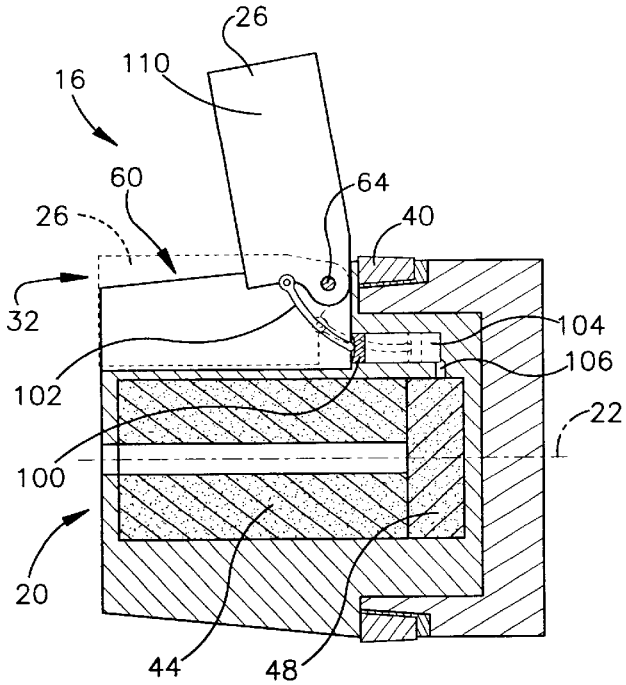
FIG. 12 is a cross-sectional view of an alternate embodiment tail section, utilizing a piston-and-linkage deployment mechanism.
Figure 13:
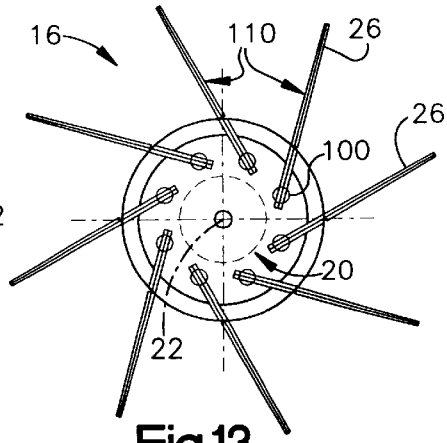
FIG. 13 is a rear view of the tail section of FIG. 12, showing one possible fully-deployed fin configuration.

Turning now to FIGS. 12 and 13, an alternative embodiment of the tail 16 is shown. The tail section 16 shown in FIG. 12 includes a piston 100, and a mechanical link 102 connecting the piston 100 to the fin 26. The piston 100 may be moved by introducing pressurized gases into a piston chamber 104 on one side of the piston 100. The pressurized gases may be provided by the bleed base device 20. To that end, a passage 106 may be provided between the bleed base device 20 and the piston chamber 104.

Figure 14:
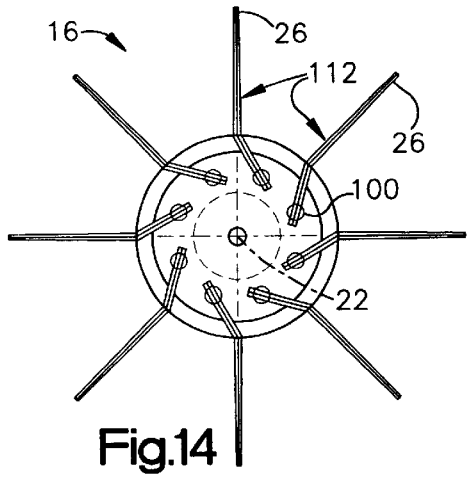
FIG. 14 is another rear view of the tail section of FIG. 12, showing another possible fully-deployed fin configuration.

Movement of the piston 100 is transmitted to the fin 26 via the link 102. Thus, as shown in FIG. 12, movement of the piston 100 causes rotation of the fin 26 about the pin 64, causing the fin to move from the stowed position 60 to a deployed position 110. As shown in FIG. 13, this deployed position 110 for the fins 26 has the fins 26 canted relative to the tail axis 22. The deployed position 110 for the fins 26 may be their final deployed position. Alternatively, another mechanism may be utilized to move the fins into a non-canted position 112, such as illustrated in FIG. 14.

Figure 15:
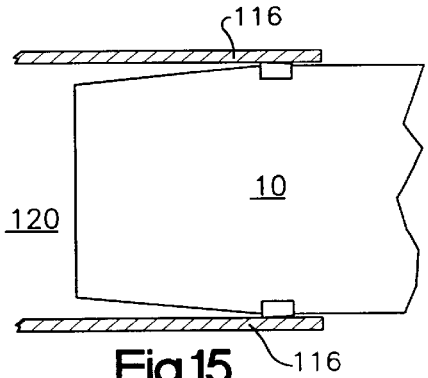
FIGS. 15 and 16 are cross-sectional views illustrating use of a muzzle blast to deploy fins in accordance with the invention.
Figure 16:
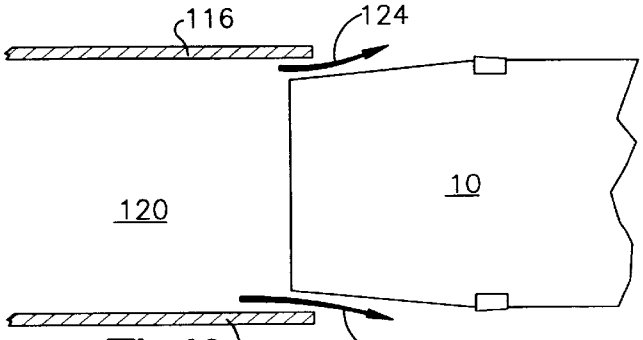

FIGS. 15 and 16 illustrate another mechanism which may be utilized in deployment of the fins 26, that of forces generated by the muzzle blast upon launch. FIG. 15 illustrates the projectile 10 as it is about to emerge from a launcher 116, such as a launch tube or gun barrel. The obturator 40 of the tail section provides a seal around an inner surface of the launcher 116. High pressure gases used to propel the projectile 10 may therefore be trapped in a high-pressure region 120 behind the projectile 10. As shown in FIG. 16, when the projectile 10 exits the launcher 116, gases from the high-pressure region 120 stream outward as a muzzle blast 124 alongside of the tail section 116. The flow in the muzzle blast 124 may cause the fins 26 to move outward, thus partially or fully deploying the fins 26.

Figure 17:
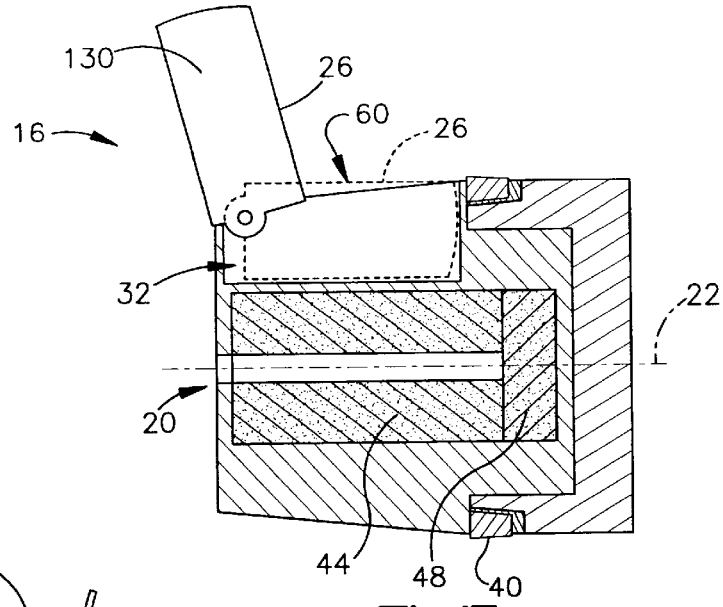
FIG. 17 is a cross-sectional view of another alternate embodiment tail section, utilizing aft-deploying fins.
Figure 18:
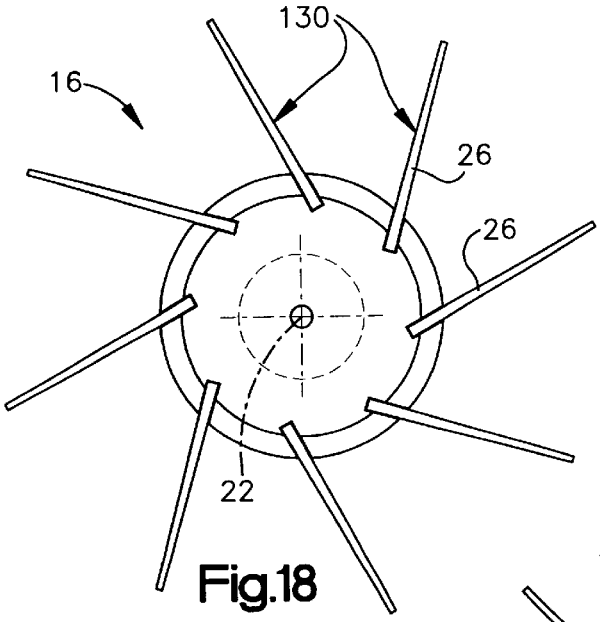
FIG. 18 is a rear view of the tail section of FIG. 17, showing one possible fully-deployed configuration of the fins.
Figure 19:
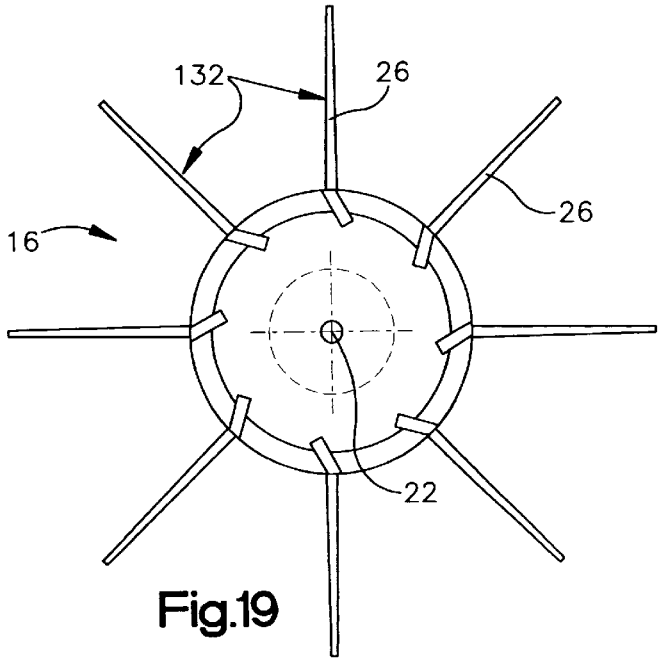
FIG. 19 is another rear view of the tail section of FIG. 17, showing another possible fully-deployed configuration of the fins.

FIGS. 17–19 illustrate aft deployment of the fin 26. In this arrangement, the pin 64 is at the aft end of the fin 26. It will be appreciated that aft-deployed fins may have a canted full deployment 130, as illustrated in FIG. 18, or alternatively may have a non-canted full deployment 132, as illustrated in FIG. 19. Suitable of the various mechanisms described above with regard to forward-deploying fins, may be utilized in deployment of the aft-deploying fins. For example, centrifugal forces, spring-assist mechanisms, piston-based or other suitable mechanical mechanisms, and/or aerodynamic forces, may be utilized in deploying the aft-deploying fins 26. In addition, it will be appreciated that aerodynamic forces generated by forward motion of the projectile 10 will tend to keep the aft-deployed fins 26 in their fully deployed position.

All of the tail section configurations described above enable a combination of deployable fins and a base bleed device. This advantageously combines the flight stability of a projectile having solid fins, with the added range and/or velocity of a projectile with a base bleed device. As noted above, such a configuration may have a range 20% above that of a corresponding projectile without a base bleed device. Stowage of the fins in a canted orientation provides more efficient use of space, facilitating this combination.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous or any given or particular application.

What is claimed is:

1. A projectile tail section comprising:

an outflow device surrounding an axis of the tall section; and a plurality of deployable, substantially planar fins stowed within the tail section around the outflow device;

wherein the axis of the tall section is not co-planar with planes of the fins, when the fins are stowed within the tail section; and wherein the tall section includes a housing with slots therein, and wherein the fins are located in the slots when the fins are stowed.

2. The tall section of claim 1, wherein the fins are canted relative to the axis of the tail section, when the fins are stowed within the tail section.

3. The tail section of claim 1, wherein the fins are configured to be deployed during flight of the projectile.

4. The tail section of claim 3, wherein the fins are configured to be deployed during flight of the projectile such that the axis of the tail section is substantially within the planes of the fins, when the fins are deployed.

5. The tail section of claim 3, wherein the fins are configured to be deployed such that the axis of the tail section is not coplanar with planes of the fins, when the fins are deployed.

6. The tail section of claim 1, further comprising pins about which respective of the fins rotate during deployment.

7. The tail section of claim 6, wherein the pins are protrusions on the fins.

8. The tail section of claim 1, wherein the outflow device includes a rocket motor.

9. The tail section of claim 6, wherein the pins fit through holes in the fins.

10. The tail section of claim 9, wherein the holes in the fins are elongated holes, allowing rotation of the fin in planes that include a pin axis of the pin.

11. The tail section of claim 6, wherein fins are also operatively configured to rotate within a plane that includes an axis of the pin.

12. The tail section of claim 1, further comprising:

a piston; and a linkage coupled to the piston and the fins;

wherein movement of the piston causes the fin to rotate about the pin.

13. The tail section of claim 12, wherein a piston chamber on one side of the piston is in communication with the outflow device.

14. The tail section of claim 1, further comprising locks that hold the fins in place, once the fins are deployed.

15. The tail section of claim 14, wherein the locks include spring-and-detent mechanisms.

16. The tail section of claim 1, wherein planes of the fins are offset from and substantially parallel the axis of the tail section, when the fins are stowed within the tail section.

17. The tail section of claim 1, wherein the outflow device includes a base bleed device.

18. The tail section of claim 1, wherein the slots have openings with respective notches; and wherein the fins pass at least partially through respective of the notches when the fins are fully deployed.

19. The tail section of claim 1, wherein the fins include aft-deploying fins.

20. The tail section of claim 1, wherein the fins include forward-deploying fins.

21. The tail section of claim 1, in combination with a body of the projectile and a nose of the projectile.

22. The tail section of claim 1, wherein the plurality of fins includes eight fins.

23. A projectile tail section comprising:

an outflow device surrounding an axis of the tail section; and a plurality of deployable, substantially planar fins stowed within the tail section around the outflow device; and pins about which respective of the fins rotate during deployment;

wherein the pins are protrusions on the fins;

wherein the axis of the tail section is not co-planar with planes of the fins, when the fins are stowed within the tail section;

wherein the tail section includes a housing with wobble cavities therein; and wherein the pins are configured to rotate about at least two axes within respective of the wobble cavities.

24. A projectile tail section comprising:

an outflow device surrounding an axis of the tail section; and a plurality of deployable fins stowed in slots within the tail section, around the outflow device;

wherein the fins are canted relative to the axis of the tail section, when the fins are stowed within the tail section.

25. The tail section of claim 24, wherein the outflow device includes a base bleed device.

26. The tail section of claim 24, wherein the outflow device includes a rocket motor.

27. The tail section of claim 24, in combination with a body of the projectile and a nose of the projectile.

28. The tail section of claim 24, wherein the plurality of fins includes eight fins.

29. A method of deploying fins for a projectile, the method comprising:

moving the fins from a stowed configuration to a partially-deployed configuration; and moving the fins from the partially-deployed configuration to a fully-deployed configuration;

wherein the fins are within slots in a tail section of the projectile when the fins are in the stowed configuration;

wherein the fins are canted relative to an axis of the tail section when the fins are in the partially-deployed configuration; and wherein the axis of the tail section is substantially within planes of the fins, when the fins are in the fully-deployed configuration.

30. A The method of claim 29, wherein the moving the fins from the stowed configuration to the partially-deployed configuration includes rotating the fins about respective pins within the slots.

31. The method of claim 29, wherein the moving the fins from the partially-deployed configuration to the fully-deployed configuration includes rotating the fins about a rotation axis which is substantially parallel to the axis of the tail section.

32. A projectile tail section comprising:

an outflow device surrounding an axis of the tail section; and a plurality of deployable, substantially planar fins stowed within the tail section around the outflow device;

wherein the axis of the tail section is not co-planar with planes of the fins, when the fins are stowed within the tail section; and wherein the axis of the tail section is substantially co-planar with planes of the fins, when the fins are deployed.

33. The tail section of claim 32, wherein the plurality of fine includes eight fins.

34. The tail section of claim 32, wherein the tail section includes a housing with slots therein; and wherein the fins are located in the slots when the fins are stowed.

* * * * *